US007448819B1

(12) United States Patent
Fu

(10) Patent No.: US 7,448,819 B1
(45) Date of Patent: Nov. 11, 2008

(54) UNIVERSAL SNAPPING CONNECTOR THAT IS LOCKED AND UNLOCKED EASILY AND QUICKLY

(76) Inventor: Yang-Li Fu, 2F, No. 113, Lane 30, Leli 3rd St., Anle District, Keelung City (TW)

( * ) Notice: Subject to any disclaimer, the term of this patent is extended or adjusted under 35 U.S.C. 154(b) by 0 days.

(21) Appl. No.: 11/766,033

(22) Filed: Jun. 20, 2007

(51) Int. Cl.
*E04G 7/24* (2006.01)

(52) U.S. Cl. ..... 403/49

(58) Field of Classification Search ..... 403/49, 403/319, 322.1, 324, 329, 344; 292/80, 87, 292/88, DIG. 61; 182/186.7, 186.8; 24/293–295, 24/458

See application file for complete search history.

(56) References Cited

U.S. PATENT DOCUMENTS 2,814,535 A * 11/1957 Jagiel ..... 403/49
2,849,258 A * 8/1958 Crook ..... 403/49
4,505,058 A * 3/1985 Peterson ..... 37/459
4,676,014 A * 6/1987 Berchem et al. ..... 37/459
4,890,948 A * 1/1990 Bondioli ..... 403/23
5,556,224 A * 9/1996 Niskanen ..... 403/379.2
5,711,401 A * 1/1998 Rchid ..... 182/129
5,961,241 A * 10/1999 Haker ..... 403/79
6,079,431 A * 6/2000 Su ..... 135/72
7,210,540 B2 * 5/2007 Ward et al. ..... 172/772.5
7,278,693 B2 * 10/2007 Smith et al. ..... 301/113
2002/0106237 A1 * 8/2002 Rogers ..... 403/49

* cited by examiner

*Primary Examiner*—Robert J Sandy
*Assistant Examiner*—Joshua T Kennedy
(74) *Attorney, Agent, or Firm*—Alan Kamrath; Kamrath & Associates PA

(57) ABSTRACT

A universal snapping connector includes two fixed members each provided with a hollow extension having a guide slot, two movable members each pivotally connected with a respective fixed member and each provided with a protrusion having a locking hole that is movable to align with the guide slot of the respective fixed member, and two elastic plates each movably mounted in the guide slot and each inserted into and locked in the locking hole of a respective movable member. Thus, a user only needs to push each of the elastic plates to lock each of the movable members onto each of the fixed members so that the universal snapping connector is locked easily and quickly.

16 Claims, 9 Drawing Sheets

UNIVERSAL SNAPPING CONNECTOR THAT IS LOCKED AND UNLOCKED EASILY AND QUICKLY

BACKGROUND OF THE INVENTION

1. Field of the Invention

The present invention relates to a connector and, more particularly, to a universal snapping connector for connecting two poles so as to construct a scaffold for a building.

2. Description of the Related Art

A conventional universal snapping connector in accordance with the prior art shown in FIGS. 8 and 9 comprises two fixed members 60 each having a first end formed with a first pivot ear 61 and a second end formed with a second pivot ear 64, two movable members 70 each having a first end pivotally connected with the first pivot ear 61 of a respective fixed member 60 and a second end provided with a protrusion 71 formed with a slit 72, two locking bolts 80 each having a first end pivotally connected with the second pivot ear 64 of a respective fixed member 60 and a threaded second end inserted into the slit 72 of the protrusion 71 of a respective movable member 70, and two locking nuts 81 each screwed onto the threaded second end of a respective locking bolt 80 and each rested on the protrusion 71 of a respective movable member 70. The second end of each of the fixed members 60 is formed with a pivot hole 62 to allow passage of a rivet 67 which pivotally connects the first ends of the fixed members 60.

In operation, after each of the locking nuts 81 is unscrewed from the threaded second end of the respective locking bolt 80, the respective locking bolt 80 is pivoted outwardly to detach from the slit 72 of the protrusion 71 of the respective movable member 70 to unlock the respective movable member 70 from the respective fixed member 60 so that the respective movable member 70 is pivoted outwardly to detach from the respective fixed member 60 for mounting a pole. After each of the movable members 70 is movable to cover the respective fixed member 60, the respective locking bolt 80 is movable and inserted into the slit 72 of the protrusion 71 of the respective movable member 70. Then, each of the locking nuts 81 is screwed onto the threaded second end of the respective locking bolt 80 and rested on the protrusion 71 of the respective movable member 70 to lock the respective movable member 70 onto the respective fixed member 60. Thus, the pole is clamped between each of the fixed members 60 and the respective movable member 70.

However, a user has to screw each of the locking nuts 81 to lock each of the movable members 70 onto the respective fixed member 60 and to unscrew each of the locking nuts 81 to unlock each of the movable members 70 from the respective fixed member 60 so that the universal snapping connector cannot be locked easily and quickly, thereby causing inconvenience to the user when operating the universal snapping connector to fasten the poles. In addition, the locking bolts 80 and the locking nuts 81 are made of metal so that the universal snapping connector has a higher price, thereby increasing the costs of fabrication. Further, the universal snapping connector cannot be locked easily and quickly, thereby wasting the working time. Further, when the locking bolts 80 and the locking nuts 81 are rusted due to the wet air, each of the movable members 70 cannot be detached from the respective fixed member 60 easily and conveniently.

BRIEF SUMMARY OF THE INVENTION

In accordance with the present invention, there is provided a universal snapping connector, comprising two fixed members each having a first end pivotally connected with each other and a second end provided with a hollow extension having a side formed with a guide slot, two movable members each having a first end pivotally connected with the first end of a respective fixed member and a second end provided with a protrusion detachably inserted into the extension of the respective fixed member and having a side formed with a locking hole that is movable to align with the guide slot of the extension of the respective fixed member, and two hollow elastic plates each movably mounted in the guide slot of the extension of a respective fixed member and each inserted into and locked in the locking hole of the protrusion of a respective movable member to lock the protrusion of the respective movable member onto the extension of the respective fixed member and to lock the respective movable member onto the respective fixed member.

The primary objective of the present invention is to provide a universal snapping connector that is locked and unlocked easily and quickly.

Another objective of the present invention is to provide a universal snapping connector, wherein a user only needs to push each of the elastic plates to lock each of the movable members onto each of the fixed members to fasten each of the poles of the scaffold so that the universal snapping connector is locked easily and quickly to facilitate the user operating the universal snapping connector to fasten the poles.

A further objective of the present invention is to provide a universal snapping connector, wherein only the elastic plates are made of metal so that the universal snapping connector has a lower price, thereby decreasing the costs of fabrication.

A further objective of the present invention is to provide a universal snapping connector, wherein each of the elastic plates is pressed to lock the universal snapping connector easily and quickly, thereby saving the working time.

A further objective of the present invention is to provide a universal snapping connector, wherein when the elastic plates are rusted due to the wet air, the elastic plates can be detached from the movable members easily and conveniently by aid of a tool, thereby facilitating the user detaching the scaffold.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
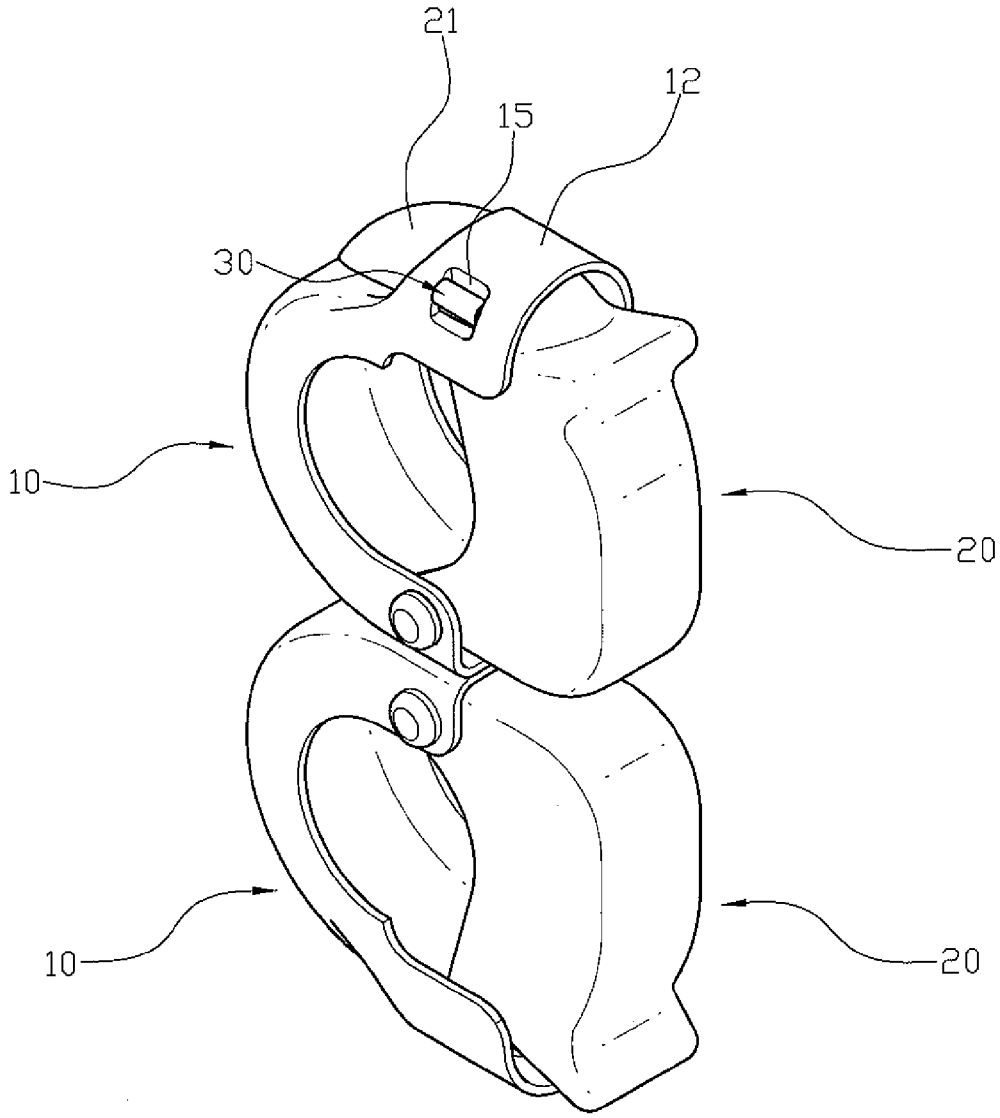
FIG. 1 is a perspective view of a universal snapping connector in accordance with the preferred embodiment of the present invention.
Figure 2:
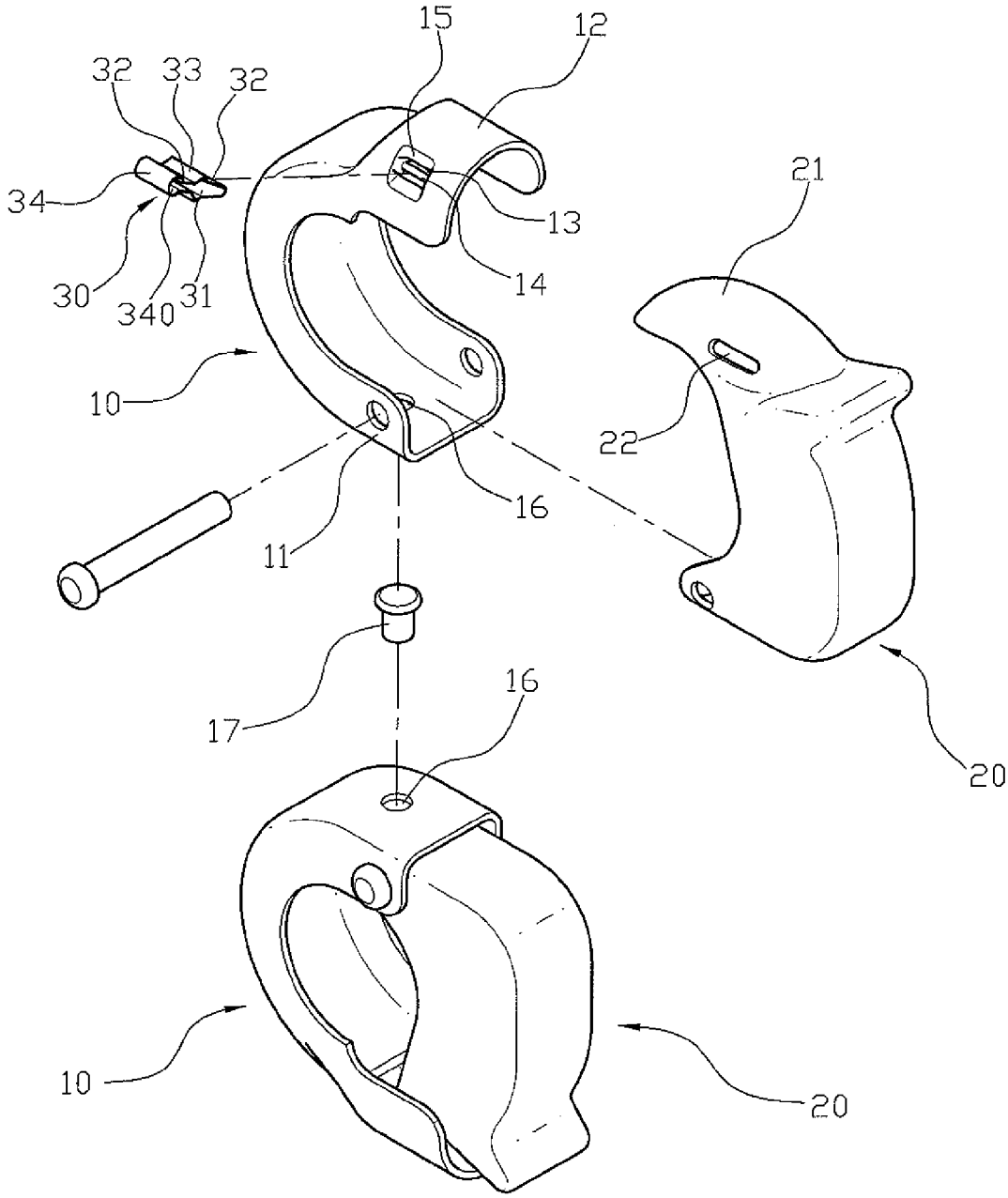
FIG. 2 is an exploded perspective view of the universal snapping connector as shown in FIG. 1.

Referring to the drawings and initially to FIGS. 1-5, a universal snapping connector in accordance with the preferred embodiment of the present invention comprises two fixed members 10 each having a first end 11 pivotally connected with each other and a second end provided with a hollow extension 12 having a side formed with a guide slot 13, two movable members 20 each having a first end pivotally connected with the first end 11 of a respective fixed member 10 and a second end provided with a protrusion 21 detachably inserted into the extension 12 of the respective fixed member 10 and having a side formed with a locking hole 22 that is movable to align with the guide slot 13 of the extension 12 of the respective fixed member 10, and two hollow elastic plates 30 each movably mounted in the guide slot 13 of the extension 12 of a respective fixed member 10 and each inserted into and locked in the locking hole 22 of the protrusion 21 of a respective movable member 20 to lock the protrusion 21 of the respective movable member 20 onto the extension 12 of the respective fixed member 10 and to lock the respective movable member 20 onto the respective fixed member 10.

Each of the fixed members 10 has a substantially C-shaped profile. The first end 11 of each of the fixed members 10 is formed with a pivot hole 16 to allow passage of a rivet 17 which pivotally connects the first ends 11 of the fixed members 10. The extension 12 of each of the fixed members 10 is provided with a limit post 14 located in the guide slot 13. The guide slot 13 of the extension 12 of each of the fixed members 10 has a periphery provided with a recessed portion 15.

Each of the movable members 20 has a substantially U-shaped profile. The protrusion 21 of each of the movable members 20 has a substantially bird-bill-shaped profile and has thickness reduced gradually toward the extension 12 of the respective fixed member 10 to provide a positioning effect between the protrusion 21 of each of the movable members 20 and the extension 12 of the respective fixed member 10 when the protrusion 21 of each of the movable members 20 is inserted into the extension 12 of the respective fixed member 10. The protrusion 21 of each of the movable members 20 has a hollow inside formed with a receiving chamber 24 connected to locking hole 22.

Each of the elastic plates 30 has an inside formed with a mounting chamber 31 movably mounted on the limit post 14 of the extension 12 of the respective fixed member 10. Each of the elastic plates 30 is integrally bendable to have a loop shape and has a distal end formed with an opening 35 connected to the mounting chamber 31, and the opening 35 of each of the elastic plates 30 is provided with an enlarged operation portion 34 to seal each of the elastic plates 30 and to prevent the limit post 14 of the extension 12 of the respective fixed member 10 from being detached from the mounting chamber 31 of each of the elastic plates 30. The operation portion 34 of each of the elastic plates 30 has a hollow inside 340 and is movable to rest on the recessed portion 15 of the extension 12 of the respective fixed member 10 to prevent each of the elastic plates 30 from being fully inserted into the guide slot 13 of the extension 12 of the respective fixed member 10.

Each of the elastic plates 30 is provided with two opposite tapered guide faces 32 to guide movement of the elastic plates 30 and an outwardly extending stop flange 33 located between the guide faces 32. The stop flange 33 of each of the elastic plates 30 is located between two opposite sides of each of the elastic plates 30, and each of the guide faces 32 has a thickness gradually reduced from the stop flange 33 toward a respective side of each of the elastic plates 30. The stop flange 33 of each of the elastic plates 30 is substantially wedge-shaped and has a size greater than that of the guide slot 13 of the extension 12 of the respective fixed member 10 and that of the locking hole 22 of the protrusion 21 of the respective movable member 20.

Figure 5:
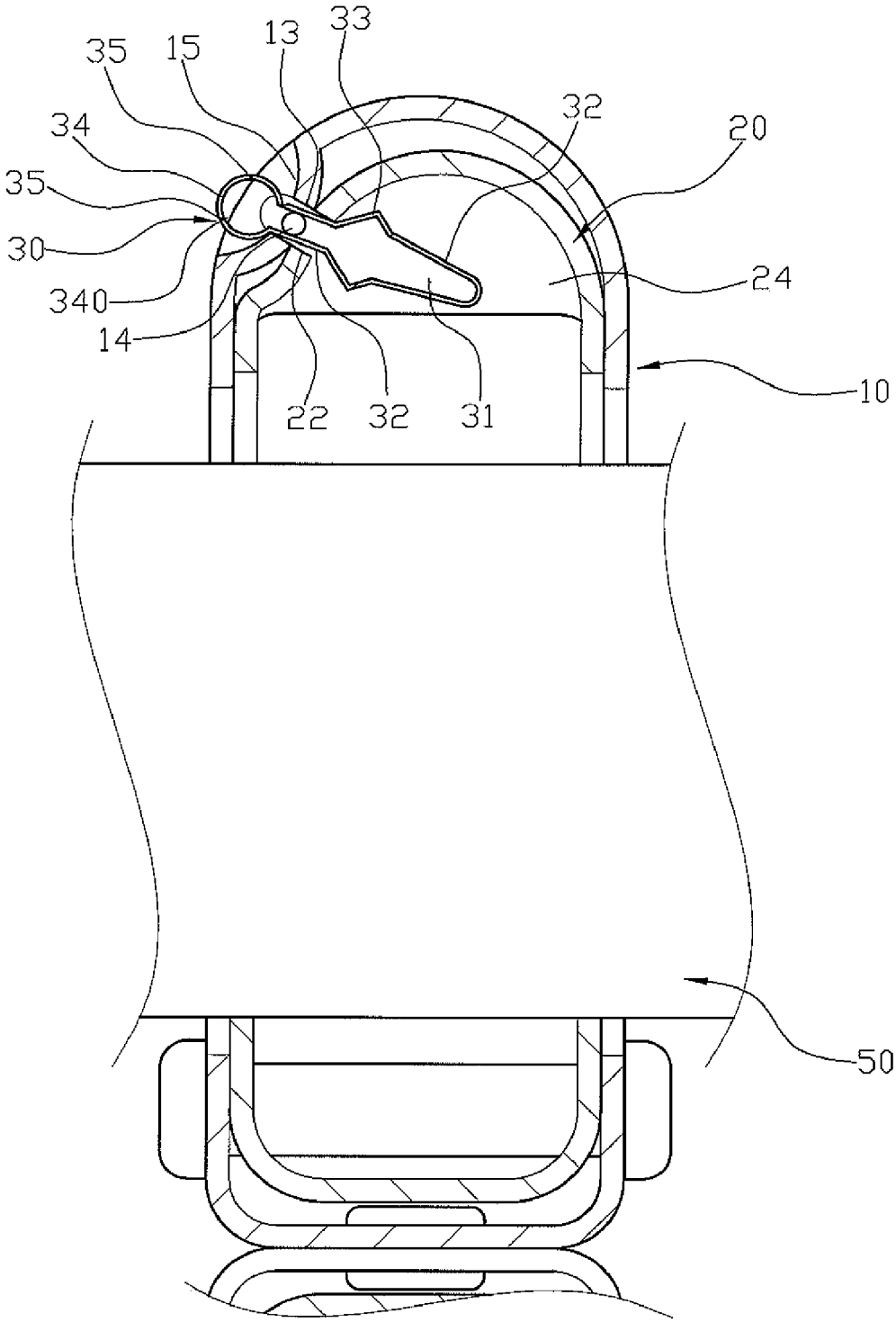
FIG. 5 is a side cross-sectional operational view of the universal snapping connector as shown in FIG. 4.

Thus, the stop flange 33 of each of the elastic plates 30 is compressed and inserted through the guide slot 13 of the extension 12 of the respective fixed member 10 and the locking hole 22 of the protrusion 21 of the respective movable member 20 into the receiving chamber 24 of the protrusion 21 of the respective movable member 20 as shown in FIG. 5. In addition, the stop flange 33 of each of the elastic plates 30 is expandable outwardly in the receiving chamber 24 of the protrusion 21 of the respective movable member 20 as shown in FIG. 5 and is movable to rest on a wall of the receiving chamber 24 of the protrusion 21 of the respective movable member 20 to prevent of each of the elastic plates 30 from being detached from the respective movable member 20.

Figure 3:
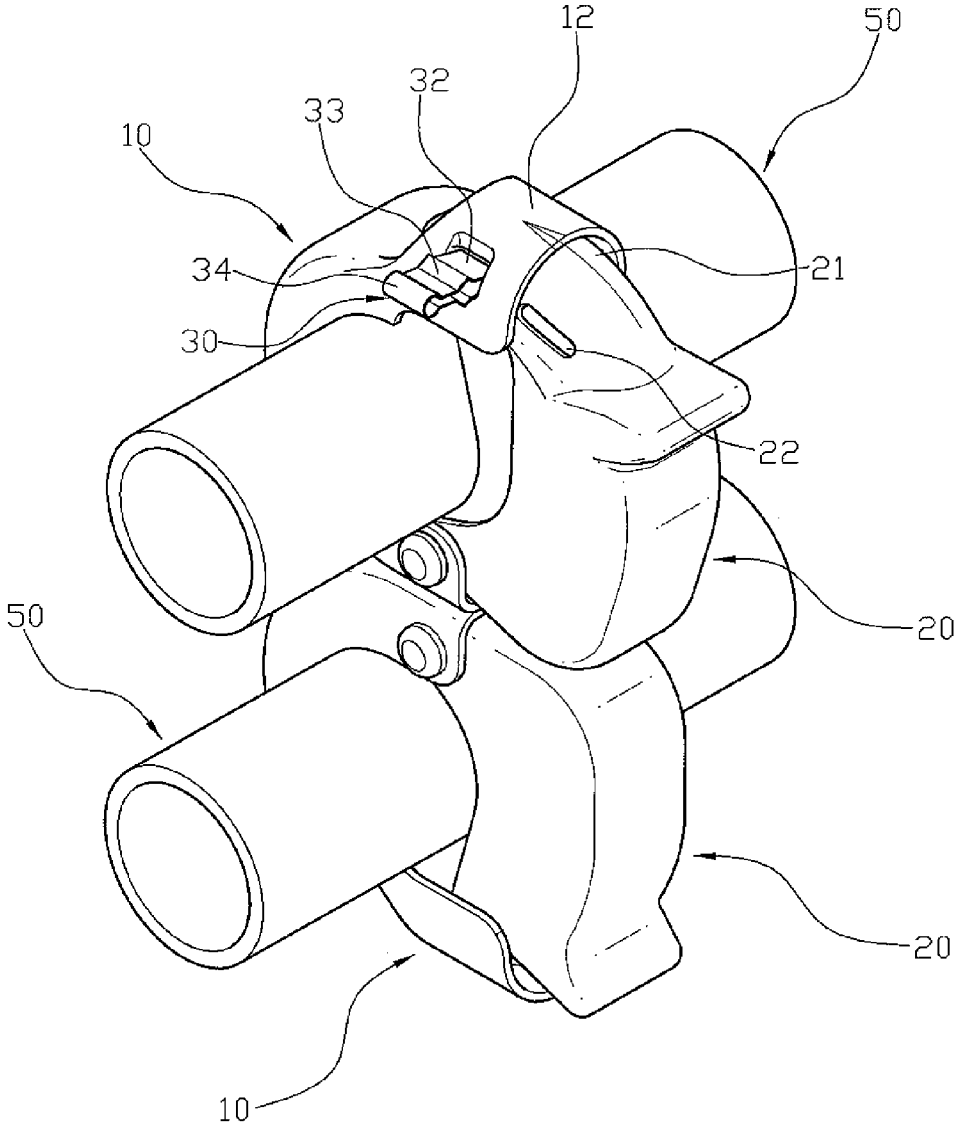
FIG. 3 is a perspective view of the universal snapping connector as shown in FIG. 1 in use.
Figure 4:
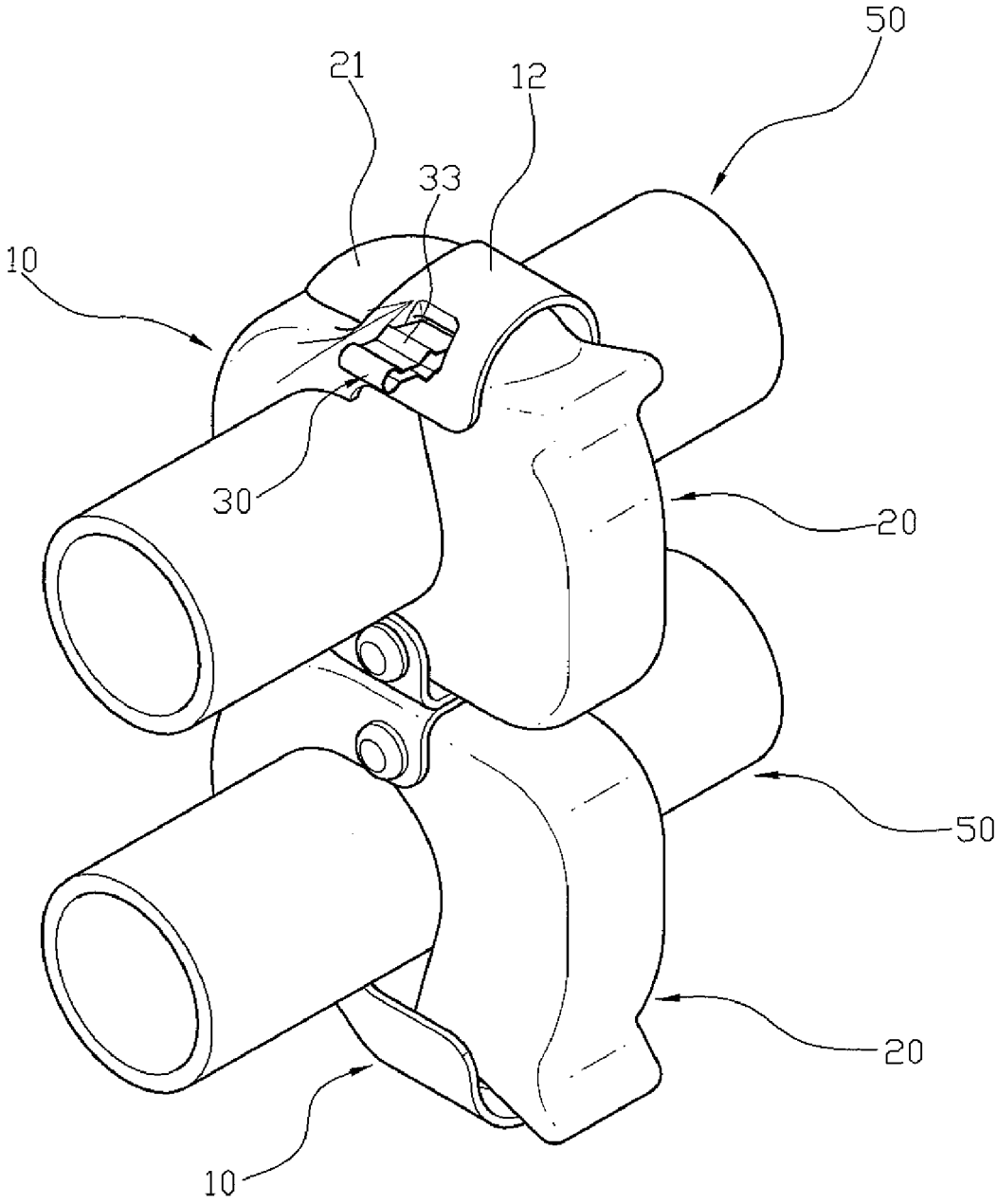
FIG. 4 is a schematic operational view of the universal snapping connector as shown in FIG. 3.

In operation, referring to FIGS. 1-5, each of the elastic plates 30 is movable outwardly relative to the protrusion 21 of the respective movable member 20 and the extension 12 of the respective fixed member 10 and is detached from the locking hole 22 of the protrusion 21 of the respective movable member 20 to unlock the protrusion 21 of the respective movable member 20 from the extension 12 of the respective fixed member 10 and to unlock the respective movable member 20 from the respective fixed member 10 so that the respective movable member 20 is pivotable outwardly relative to the respective fixed member 10. After the fixed members 10 are mounted on two poles 50 of a scaffold, each of the movable members 20 is movable toward the respective fixed member 10, and the protrusion 21 of each of the movable members 20 is inserted into the extension 12 of the respective fixed member 10 as shown in FIG. 3. After the locking hole 22 of the protrusion 21 of each of the movable members 20 is movable to align with the guide slot 13 of the extension 12 of the respective fixed member 10, each of the elastic plates 30 is pushed toward the protrusion 21 of the respective movable member 20 and the extension 12 of the respective fixed member 10 as shown in FIG. 4, and the stop flange 33 of each of the elastic plates 30 is compressed and inserted through the guide slot 13 of the extension 12 of the respective fixed member 10 and the locking hole 22 of the protrusion 21 of the respective movable member 20 into the receiving chamber 24 of the protrusion 21 of the respective movable member 20 as shown in FIG. 5. Then, the stop flange 33 of each of the elastic plates 30 is expandable outwardly in the receiving chamber 24 of the protrusion 21 of the respective movable member 20 as shown in FIG. 5 to prevent of each of the elastic plates 30 from being detached from the respective movable member 20. In such a manner, the protrusion 21 of each of the movable members 20 is snapped onto the extension 12 of the respective fixed member 10 by the respective elastic plate 30 so that each of the movable members 20 is locked onto the respective fixed member 10 to fasten the respective pole 50. Thus, the fixed members 10 and the movable members 20 are combined together to connect two poles 50 of a scaffold.

Figure 6:
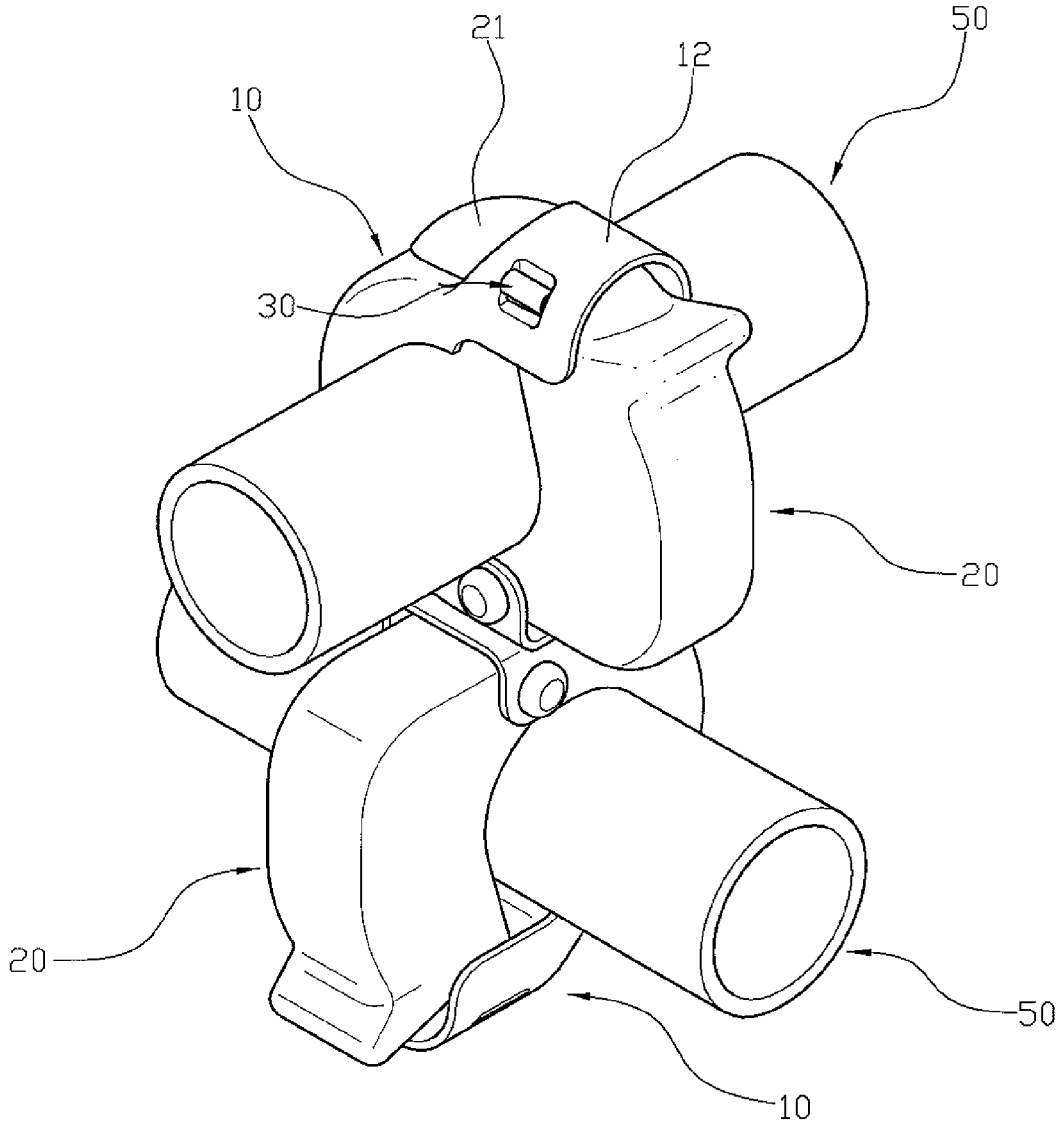
FIG. 6 is a schematic operational view of the universal snapping connector as shown in FIG. 4.

As shown in FIG. 6, the fixed members 10 are pivoted relative to each other to change the directions of the two poles 50. Thus, the poles 50 are in turn connected upwardly and successively to construct the scaffold.

Figure 7:
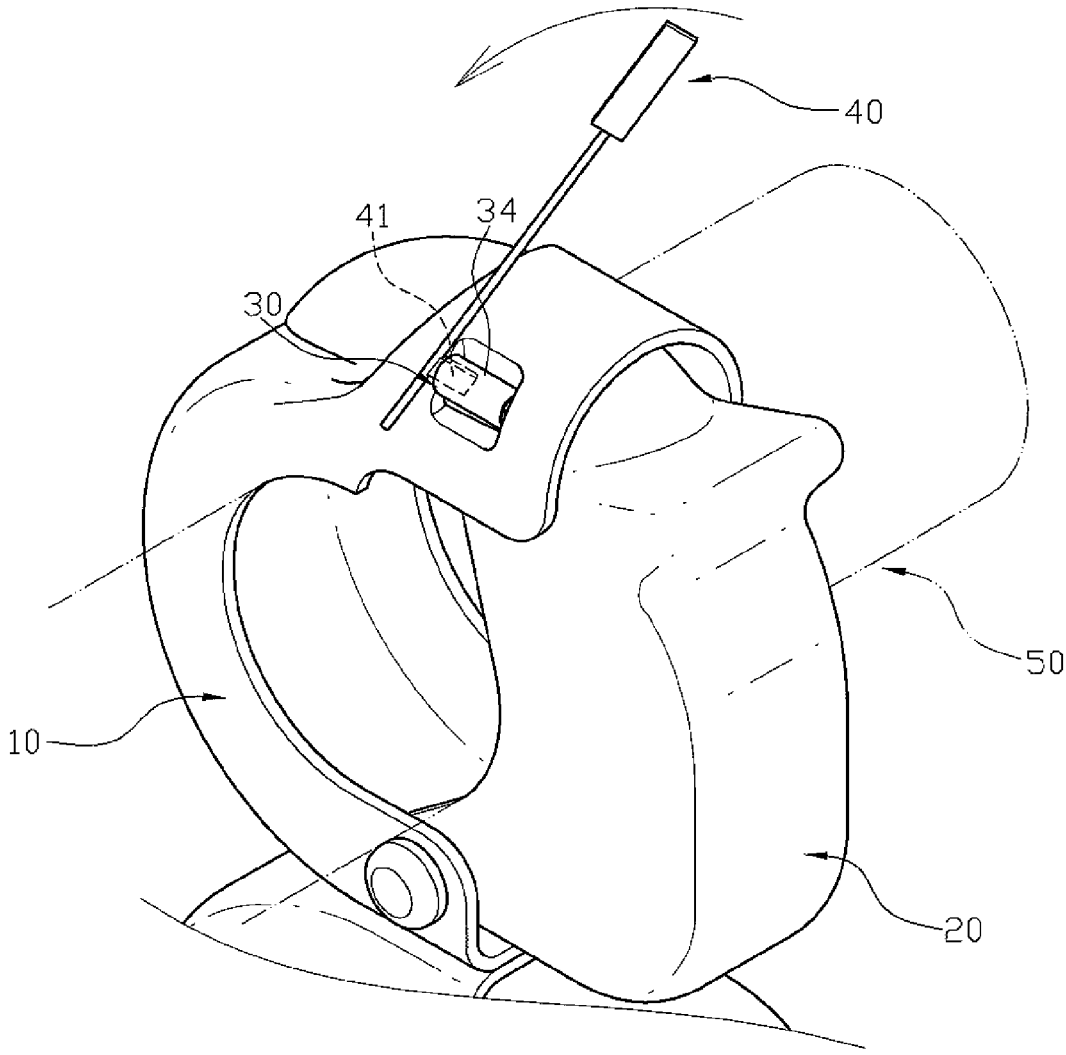
FIG. 7 is a schematic operational view of the universal snapping connector as shown in FIG. 4.
Figure 8:
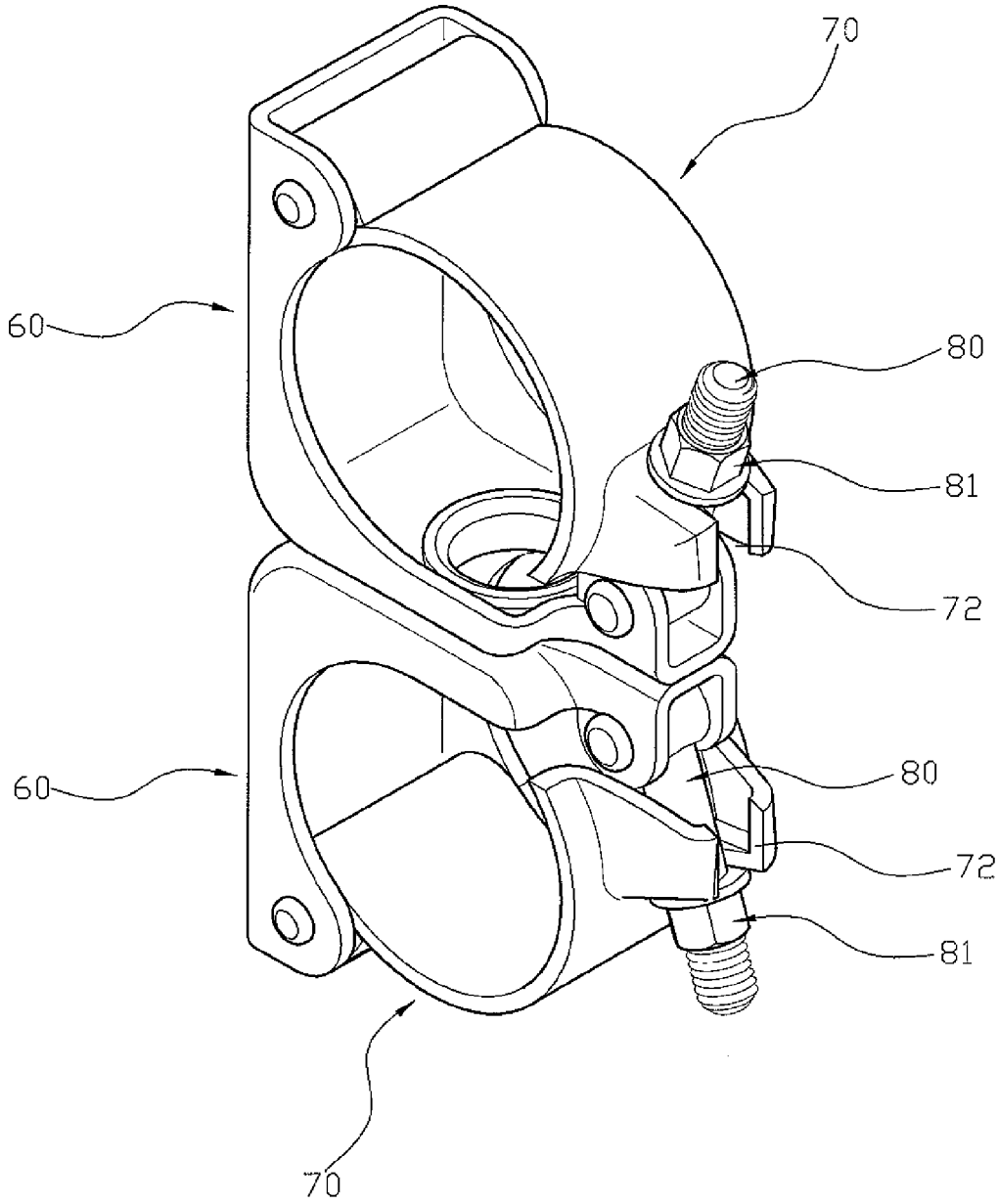
FIG. 8 PRIOR ART
FIG. 8 is a perspective view of a conventional universal snapping connector in accordance with the prior art.
Figure 9:
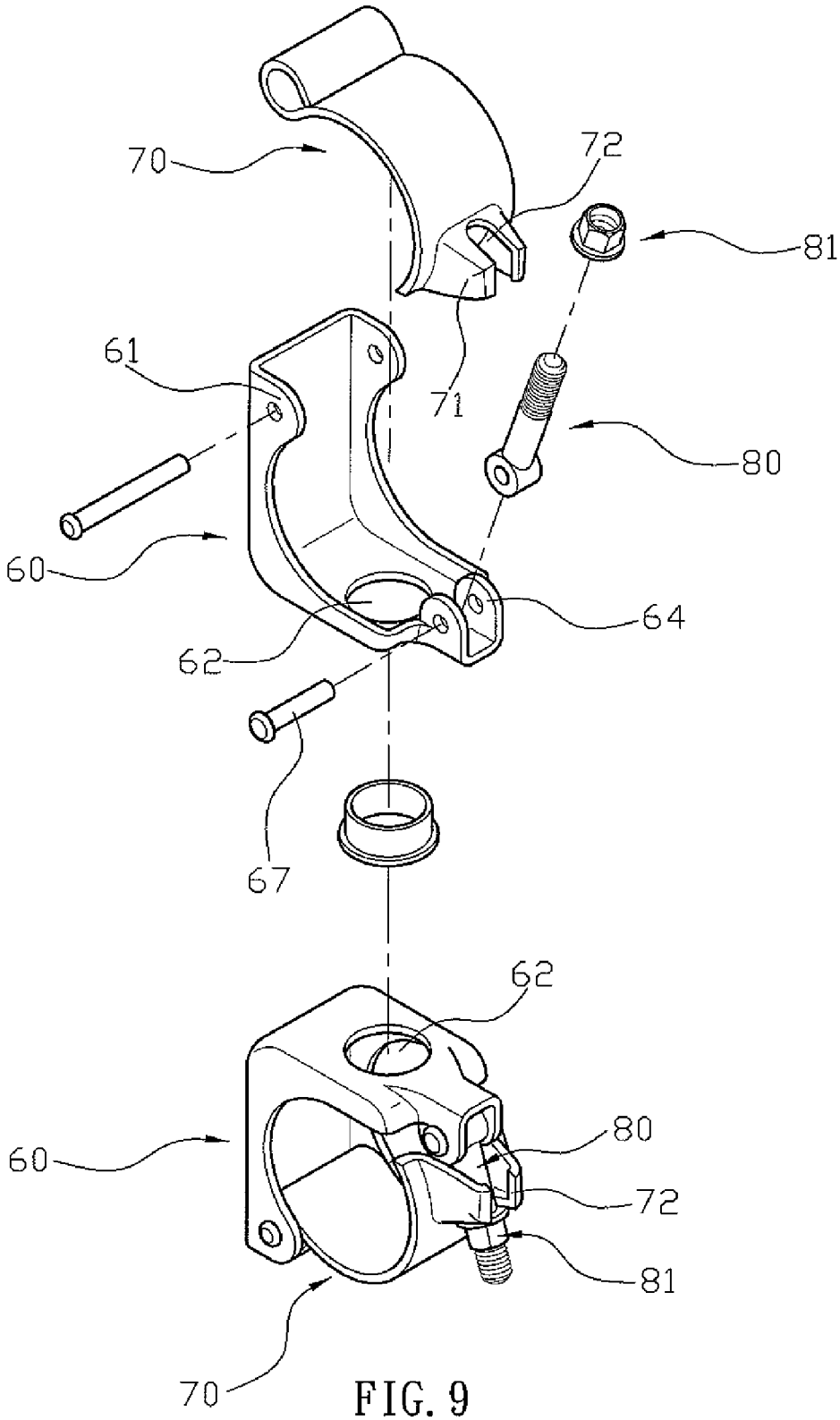
FIG. 9 PRIOR ART
FIG. 9 is an exploded perspective view of the conventional universal snapping connector as shown in FIG. 8.

As shown in FIG. 7, a tool 40 has a distal end provided with a drive block 41 that is inserted into the hollow inside 340 of the operation portion 34 of each of the elastic plates 30 to push each of the elastic plates 30 outwardly relative to the protrusion 21 of the respective movable member 20 and the extension 12 of the respective fixed member 10 so that each of the elastic plates 30 is detached from the locking hole 22 of the protrusion 21 of the respective movable member 20 to unlock the protrusion 21 of the respective movable member 20 from the extension 12 of the respective fixed member 10 and to unlock the respective movable member 20 from the respective fixed member 10 so as to release the respective pole 50.

Accordingly, a user only needs to push each of the elastic plates 30 to lock each of the movable members 20 onto each of the fixed members 10 to fasten each of the poles 50 of the scaffold so that the universal snapping connector is locked easily and quickly to facilitate the user operating the universal snapping connector to fasten the poles 50. In addition, only the elastic plates 30 are made of metal so that the universal snapping connector has a lower price, thereby decreasing the costs of fabrication. Further, each of the elastic plates 30 is pressed to lock the universal snapping connector easily and quickly, thereby saving the working time. Further, when the elastic plates 30 are rusted due to the wet air, the elastic plates 30 can be detached from the movable members 20 easily and conveniently by aid of a tool 40, thereby facilitating the user detaching the scaffold.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A universal snapping connector, comprising:

two fixed members each having a first end pivotally connected with each other and a second end provided with a hollow extension having a side formed with a guide slot and a limit post spanning the guide slot;

two movable members each having a first end pivotally connected with the first end of a respective fixed member and a second end provided with a protrusion detachably inserted into the extension of the respective fixed member and having a side formed with a locking hole that is movable to align with the guide slot of the extension of the respective fixed member; and two elastic plates, each integrally bendable to form a loop shape and each movably mounted in the guide slot of the extension of a respective fixed member about the limit post, and each loop shaped elastic plate is compressed, facilitating insertion into the locking hole of the protrusion of a respective movable member, once fully inserted, the elastic plate expands outwardly to lock the protrusion of the respective movable member onto the extension of the respective fixed member and to lock the respective movable member onto the respective fixed member.

2. The universal snapping connector in accordance with claim 1, wherein the protrusion of each of the movable members has a substantially bird-bill-shaped profile.

3. The universal snapping connector in accordance with claim 1, wherein the protrusion of each of the movable members has thickness reduced gradually toward the extension of the respective fixed member to provide a positioning effect between the protrusion of each of the movable members and the extension of the respective fixed member when the protrusion of each of the movable members is inserted into the extension of the respective fixed member.

4. The universal snapping connector in accordance with claim 1, wherein each of the elastic plates has a distal end formed with an opening connected to the mounting chamber, and the opening of each of the elastic plates is provided with an enlarged operation portion to seal each of the elastic plates and to prevent the limit post of the extension of the respective fixed member from being detached from the mounting chamber of each of the elastic plates.

5. The universal snapping connector in accordance with claim 4, wherein:

the guide slot of the extension of each of the fixed members has a periphery provided with a recessed portion;

the operation portion of each of the elastic plates is movable to rest on the recessed portion of the extension of the respective fixed member to prevent each of the elastic plates from being fully inserted into the guide slot of the extension of the respective fixed member.

6. The universal snapping connector in accordance with claim 4, wherein:

the operation portion of each of the elastic plates has a hollow inside;

the universal snapping connector further comprises a tool having a distal end provided with a drive block that is inserted into the hollow inside of the operation portion of each of the elastic plates to push each of the elastic plates outwardly relative to the protrusion of the respective movable member and the extension of the respective fixed member so that each of the elastic plates is detached from the locking hole of the protrusion of the respective movable member to unlock the protrusion of the respective movable member from the extension of the respective fixed member and to unlock the respective movable member from the respective fixed member so as to release the respective pole.

7. The universal snapping connector in accordance with claim 1, wherein each of the elastic plates is provided with two opposite tapered guide faces to guide movement of the elastic plates and an outwardly extending stop flange located between the guide faces.

8. The universal snapping connector in accordance with claim 7, wherein the stop flange of each of the elastic plates is located between two opposite sides of each of the elastic plates, and each of the guide faces has a thickness gradually reduced from the stop flange toward a respective side of each of the elastic plates.

9. The universal snapping connector in accordance with claim 7, wherein the stop flange of each of the elastic plates is substantially wedge-shaped.

10. The universal snapping connector in accordance with claim 7, wherein the stop flange of each of the elastic plates has a size greater than that of the guide slot of the extension of the respective fixed member and that of the locking hole of the protrusion of the respective movable member.

11. The universal snapping connector in accordance with claim 7, wherein:

the protrusion of each of the movable members has a hollow inside formed with a receiving chamber connected to locking hole;

the stop flange of each of the elastic plates is compressed and inserted through the guide slot of the extension of the respective fixed member and the locking hole of the protrusion of the respective movable member into the receiving chamber of the protrusion of the respective movable member.

12. The universal snapping connector in accordance with claim 11, wherein the stop flange of each of the elastic plates is expandable outwardly in the receiving chamber of the protrusion of the respective movable member.

13. The universal snapping connector in accordance with claim 11, wherein the stop flange of each of the elastic plates is movable to rest on a wall of the receiving chamber of the protrusion of the respective movable member to prevent of each of the elastic plates from being detached from the respective movable member.

14. The universal snapping connector in accordance with claim 1, wherein each of the fixed members has a substantially C-shaped profile.

15. The universal snapping connector in accordance with claim 1, wherein each of the movable members has a substantially U-shaped profile.

16. The universal snapping connector in accordance with claim 1, wherein each of the elastic plates is movable outwardly relative to the protrusion of the respective movable member and the extension of the respective fixed member and is detachable from the locking hole of the protrusion of the respective movable member.

* * * * *